US005937480A

United States Patent [19]

Kiefer

[11] Patent Number: 5,937,480

[45] Date of Patent: Aug. 17, 1999

[54] HINGE

[75] Inventor: James Kiefer, Grand Rapids, Mich.

[73] Assignee: Ran Enterprises, Inc., Grand Rapids, Mich.

[21] Appl. No.: 08/862,072

[22] Filed: May 22, 1997

[51] Int. Cl.[6] ..... E05D 7/10

[52] U.S. Cl. ..... 16/260; 16/272

[58] Field of Search ..... 16/260–263, 270–272, 16/254, 266, 246, 249, 382

[56] References Cited

U.S. PATENT DOCUMENTS

| | | | |
|---|---|---|---|
| 388,409 | 8/1888 | Grau . | |
| 523,304 | 7/1894 | Collins . | |
| 546,909 | 9/1895 | Spencer . | |
| 617,043 | 1/1899 | Phifer . | |
| 650,492 | 5/1900 | Shoemaker | 16/270 |
| 888,049 | 5/1908 | Squires et al. . | |
| 891,275 | 6/1908 | Marr . | |
| 1,092,236 | 4/1914 | Wrikeman . | |
| 1,186,637 | 6/1916 | Williams | 16/272 |
| 1,228,481 | 6/1917 | Saino . | |
| 1,360,284 | 11/1920 | Gagnon . | |
| 1,469,525 | 10/1923 | Nadolney . | |
| 1,481,142 | 1/1924 | Minton et al. . | |
| 1,569,619 | 1/1926 | Cranzler . | |
| 2,027,888 | 1/1936 | Solomon . | |
| 2,211,581 | 8/1940 | Ross . | |
| 3,191,217 | 6/1965 | Squire | 16/271 |
| 3,965,532 | 6/1976 | Wigfall | 16/270 |
| 4,305,614 | 12/1981 | Holka et al. . | |
| 4,407,044 | 10/1983 | Iseki . | |
| 4,532,675 | 8/1985 | Salazar . | |
| 4,807,331 | 2/1989 | Calucci | 16/262 |
| 5,038,436 | 8/1991 | Ihrke . | |
| 5,067,201 | 11/1991 | Marchione . | |
| 5,095,582 | 3/1992 | Ohlsson . | |
| 5,297,314 | 3/1994 | Bender . | |
| 5,361,455 | 11/1994 | Kiefer . | |
| 5,398,379 | 3/1995 | Kiefer . | |

FOREIGN PATENT DOCUMENTS

| | | |
|---|---|---|
| 82087 | 6/1983 | European Pat. Off. . |
| 2620759 | 3/1989 | France . |
| 2644505 | 9/1991 | France . |
| 286632 | 8/1915 | Germany . |
| 398963 | 9/1933 | United Kingdom . |
| 502209 | 3/1939 | United Kingdom . |
| 1431673 | 4/1973 | United Kingdom . |

*Primary Examiner*—Chuck Y. Mah

*Attorney, Agent, or Firm*—Van Dyke, Gardner, Linn & Burkhart, LLP

[57] ABSTRACT

A hinge especially suited for securing the rear gate of a vehicle to a vehicle body. The hinge is moveable between a retracted and an extended position. In the extended position, the hinge facilitates painting of the vehicle body and gate, especially the area between the vehicle body and gate, including the hinge itself. The hinge is maintained in the extended position without the need to insert a screw, or other extraneous member, into the hinge, thereby simplifying the painting procedure.

20 Claims, 5 Drawing Sheets

HINGE

BACKGROUND OF THE INVENTION

This invention relates generally to hinges, and more particularly to hinges moveable between a retracted and an extended position to thereby facilitate the painting of a vehicle.

During the manufacturing process of cars, trucks, and other vehicles, the body of the vehicle and the vehicle's doors and rear gate are typically painted together simultaneously. The simultaneous painting insures that the vehicle body, doors and gate are all of a precisely matching color. Because the hinges which connect the vehicle doors and rear gate to the vehicle body are also typically painted, it is desirable that the doors and gate be attached to the vehicle during the painting process. However, due to the generally small spaces between the doors or gate and the vehicle body, it is difficult to paint therebetween. This difficulty often necessitates painting the gates and doors in a first position, and then following this up with a second step of painting when the doors and gates are in a second position. This second step, of course, requires extra time and expense and is therefore desirably eliminated.

In the past, the problem of painting the relatively inaccessible areas between the vehicle body and gates or doors has been solved by the use of extendable hinges. The extendable hinges are moveable between a retracted normal position and an extended painting position. In the extended painting position, the gate or doors are spaced a sufficient distance away from the vehicle body to enable painting therebetween to be accomplished satisfactorily and in a single step. After painting, the hinge is moved back and secured in its retracted position and thereafter functions as a normal hinge. While these hinges have greatly facilitated the painting of vehicles, the past hinges have not been completely without their own disadvantages.

One disadvantage of the prior extendable hinges has been the necessity of inserting one or more screws, or other extraneous parts, into the hinge to secure it in the extended painting position. This requires an additional labor step and therefore slows down the manufacturing process and adds expense. Another disadvantage of prior extendable hinges has been the need to discard the screws used to secure the hinge in the extended position. These screws have typically been discarded for two reasons. First, these screws are often scuffed when they hold the hinge they hold the hinge and attached gate in the extended position, and are therefore desirably replaced with new screws to secure the hinge in its retracted position. Second, in some prior extendable hinges it is necessary to provide additional screws to secure the hinge in the retracted position after painting. Because these additional screws will not have been painted, they will not match the other screws. In such a case, it is typically desirable to replace the painted screws with unpainted screws so that all the screws match. The discarding of screws, of course, results in undesirable waste and expense. Some prior extendable hinges also suffer from the disadvantage of requiring welding, riveting, or the like of various parts of the hinge to manufacture it. These types of steps increase the cost of manufacturing the hinge, and are therefore undesirable.

SUMMARY OF THE INVENTION

A hinge according to one aspect of the present invention includes a base, an intermediate member, and a bracket. The base is adapted to be secured to a stationary element, such as a vehicle body, and the bracket is adapted to be secured to a movable element, such as a vehicle rear door or gate. The intermediate member connects the bracket to the base.

Either the base or the intermediate member includes at least one slide track and the other of the intermediate member and base includes at least one slide member which slidingly engages the slide track. The slide member and slide track movably secure the intermediate member to the base such that the intermediate member is movable from a retracted position adjacent the base to an extended position away from the base. The slide member is adapted to be releasably held on the slide track when the intermediate member is in the extended position without the necessity of inserting one or more screws into the hinge. The bracket is pivotally secured to the intermediate member and thereby allows the gate of the vehicle to be opened and closed on the vehicle. The movable nature of the intermediate member with respect to the base allows the movable element to be extended away from the stationary element in order for painting therebetween to be facilitated. Moreover, the slide member is designed so that screws do not have to be inserted into the hinge to secure it in the extended position, thereby eliminating this extra step in the painting process. Without the necessity of screws to hold the hinge in the extended position, the prior practice of discarding screws is also eliminated.

These and other benefits, results, and objects of the present invention will be apparent to one skilled in the art, in light of the following specification when read in conjunction with the accompanying drawings.

DESCRIPTION OF THE PREFERRED EMBODIMENTS

Figure 1:
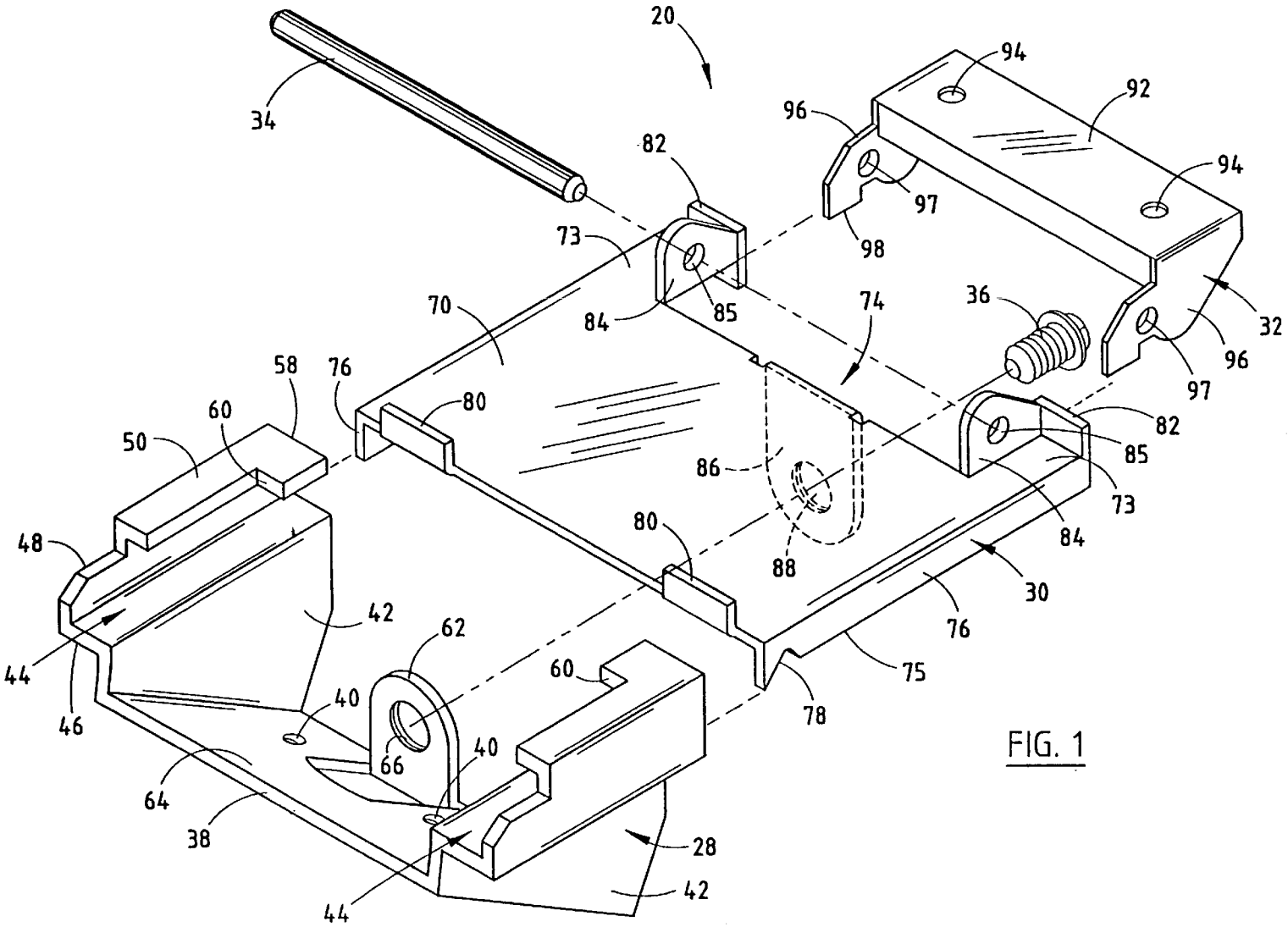
FIG. 1 is an exploded, perspective view of a hinge according to one embodiment of the present invention.
Figure 4:
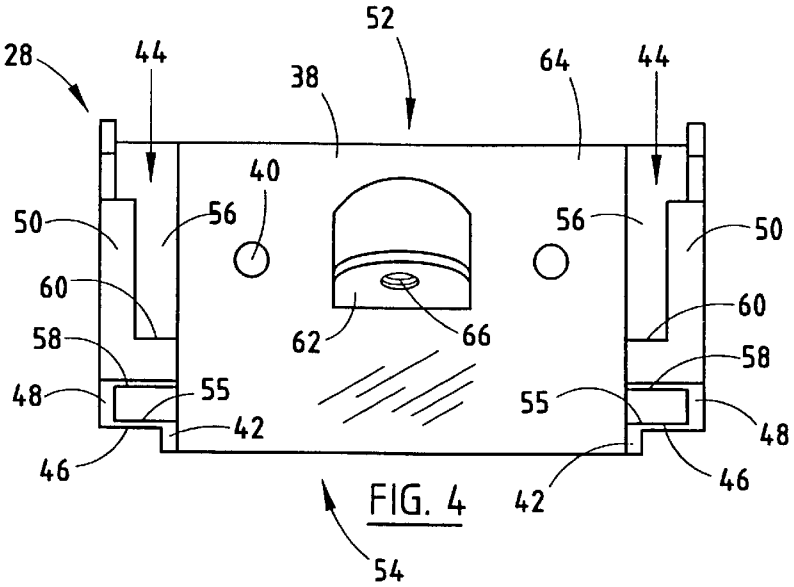
FIG. 4 is a plan view of the base.
Figure 5:
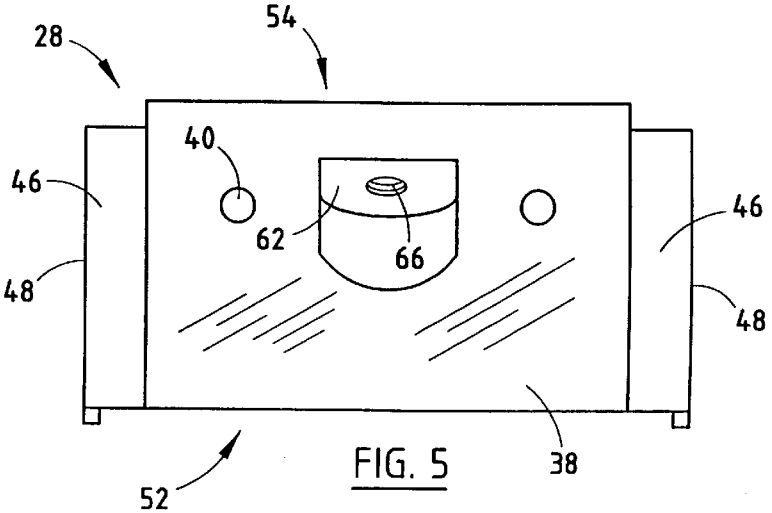
FIG. 5 is a bottom view of the base.
Figure 2:
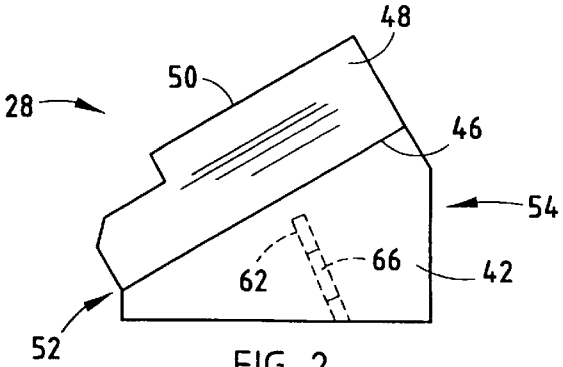
FIG. 2 is a side elevational view of a base according to one embodiment of the present invention.
Figure 3:
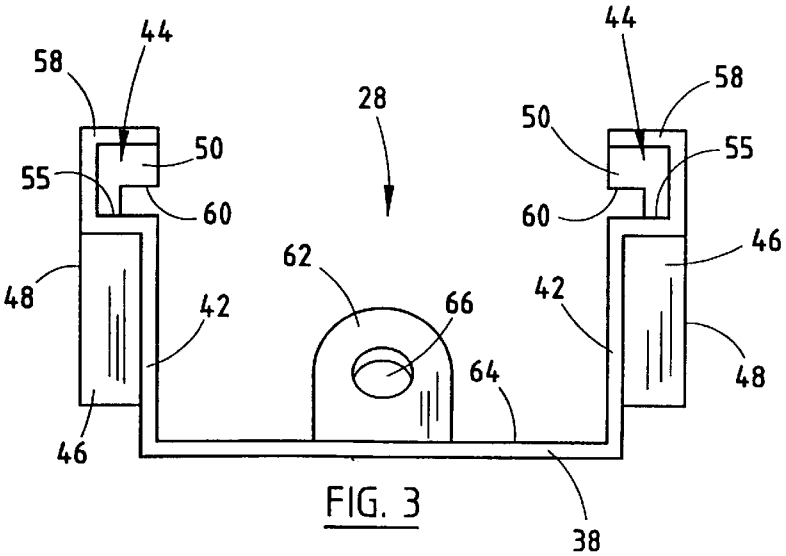
FIG. 3 is a rear, elevational view of the base.
Figure 6:
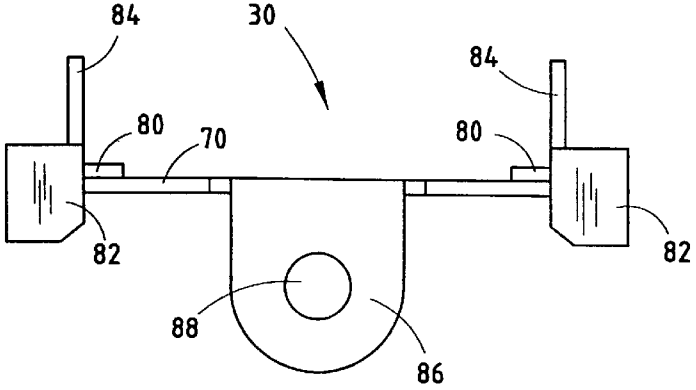
FIG. 6 is a rear, elevational view of an intermediate member according to one embodiment of the present invention.

The present invention will now be described with reference to the accompanying drawings wherein like reference numerals correspond to like elements in the several drawings. A hinge 20 according to one embodiment of the present invention is especially suited to secure a rear door or gate 22 of a vehicle to the body of the vehicle 24 (FIGS. 14–17).

Figure 15:
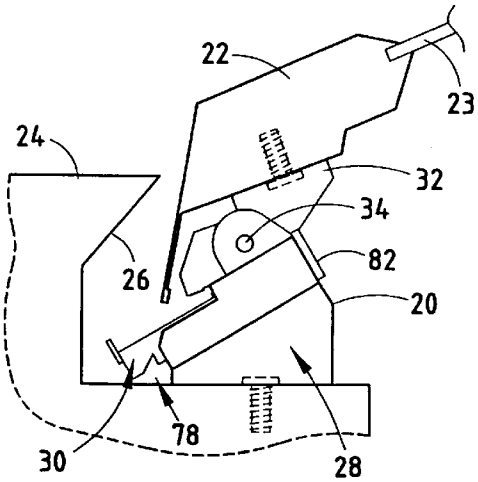
FIG. 15 is a side, partial, elevational view of the hinge of FIG. 14 shown in a retracted, rotated position.
Figure 14:
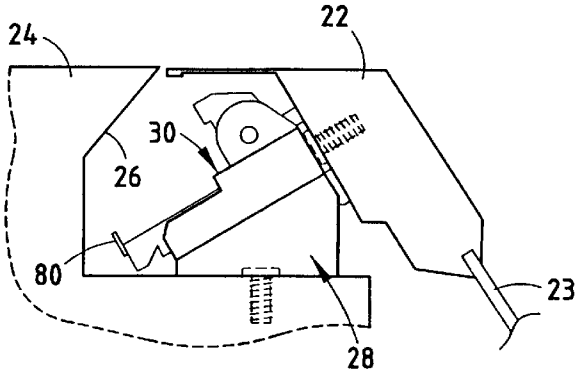
FIG. 14 is a side, partial, elevational view of the hinge attached to a vehicle body and vehicle gate in a retracted, nonrotated position.
Figure 17:
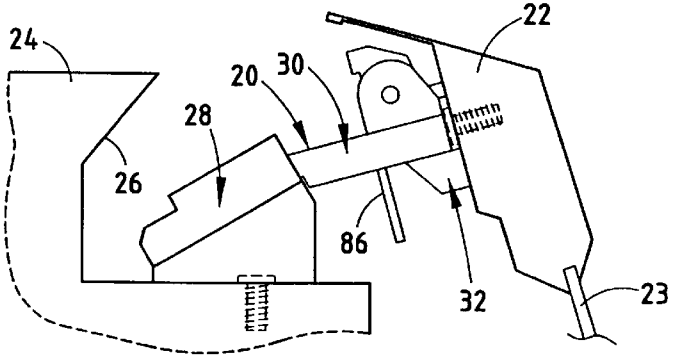
Figure 16:
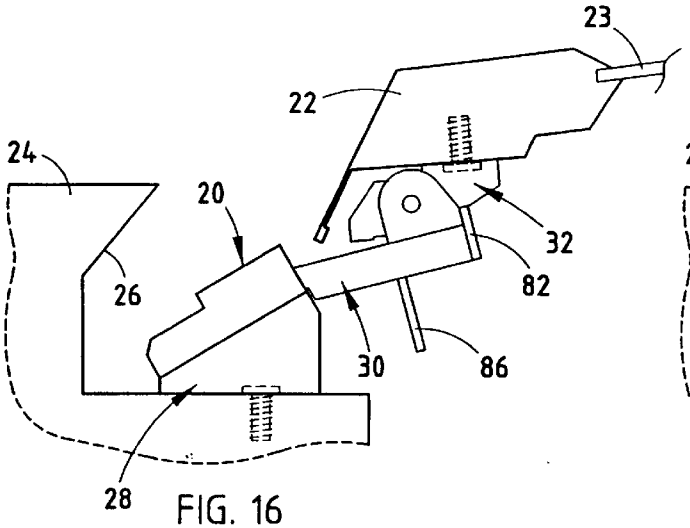
FIG. 16 is a side, partial, elevational view of the hinge of FIG. 14 shown in an extended, rotated position; and, FIG. 17 is a side, partial, elevational view of the hinge of FIG. 14 shown in an extended, nonrotated position.

Rear door 22 typically pivots upwardly and downwardly to allow ingress and egress into the rear of an automobile, and includes a rear window glass panel 23. Prior to the completion of the manufacturing process, and especially the painting process, hinge 20 is moved to an extended position away from vehicle body 24 (FIGS. 16–17). In the extended position the space between gate 22 and vehicle body 24 is great enough to allow complete painting of the vehicle body, gate, and hinge. After the manufacturing process of the vehicle is complete, hinge 20 is secured in a retracted position. In either the retracted or extended position, hinge 20 is rotatable from a position in which rear door 22 is lowered (FIGS. 14 and 17) to a position in which rear door 22 is completely open (FIGS. 15 and 16).

Hinge 20 includes a base 28, an intermediate member 30, and a bracket 32 (FIG. 1). Intermediate member 30 is slidably secured to base 28 between a retracted position and an extended position. A pivot axle or pin 34 pivotally secures bracket 32 to intermediate member 30 on a side of intermediate member 30 away from base 28. A screw, bolt, or the like 36 secures intermediate member 30 to base 28 in the retracted position. Base 28 is adapted to be secured to the vehicle body 24, and bracket 32 is adapted to be secured to the rear door or gate 22 of the vehicle. For purposes of description, the terms "front" or "forward" and "rear" or "back" will correspond to the front and rear of the vehicle, respectively. Thus, base 28 is at the front of hinge 20 and bracket 32 is at the rear of hinge 20.

Base 28 includes a generally planar attachment plate 38 which defines one or more screw holes 40 through which screws, or the like, are inserted to secure base 28 to vehicle body 24 (FIGS. 1–5). It will be understood that the precise location and number of screw holes 40 in base attachment plate 38 can be varied, and that other methods of fastening base 28 to vehicle body 24 are contemplated.

A pair of side walls 42 extend upwardly at generally right angles on either side of attachment plate 38. A slide track or channel 44 is defined at the top of each side wall 42. Each slide track 44 includes a bottom 46, side 48, and top 50. Bottom 46 is oriented generally at a right angle to side wall 42 and extends upwardly along side wall 42 from a front side 52 of base 28 to a rear side 54 of base 28. Bottom 46 thereby defines an angled sliding surface 56 (FIG. 4) upon which intermediate member 30 slides. At the back end of angled sliding surface 56 is an indexing edge or engagement lip 55, which is used to releasably hold intermediate member 30 in an extended position as will be described more fully below. Sides 48 extend upwardly from the outer ends of bottom 46 at a right angle and are generally parallel to side walls 42. Tops 50 are oriented at angle to sides 48 and are generally "L" shaped. The lower leg of the "L" of each of tops 50 defines a retraction limit surface 58 on a rearward side of top 50, and an extension limit surface 60 on a forward side of top 50.

Base attachment plate 38 includes a retaining flange 62 extending upwardly from a top surface 64 of base attachment plate 38. Retaining flange 62 is tilted with respect to base attachment plate 38 such that it is parallel to an engagement flange 86 on intermediate member 30 described below. Retaining flange 62 defines a circular, threaded aperture 66 which receives screw 36 and, in combination with engagement flange 86, selectively secures intermediate member 30 to base 28.

Figure 8:
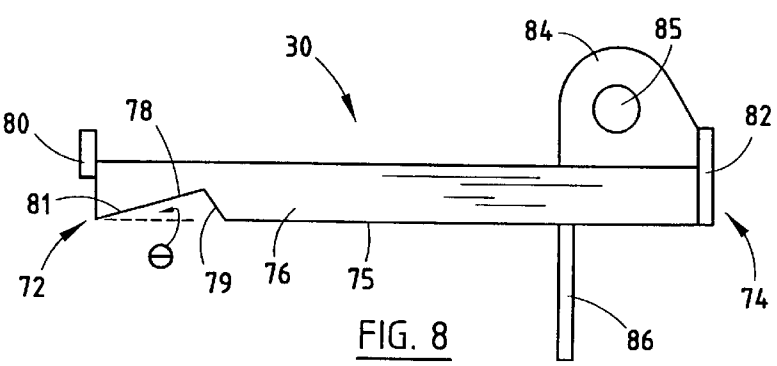
FIG. 8 is a side, elevational view of the intermediate member.
Figure 7:
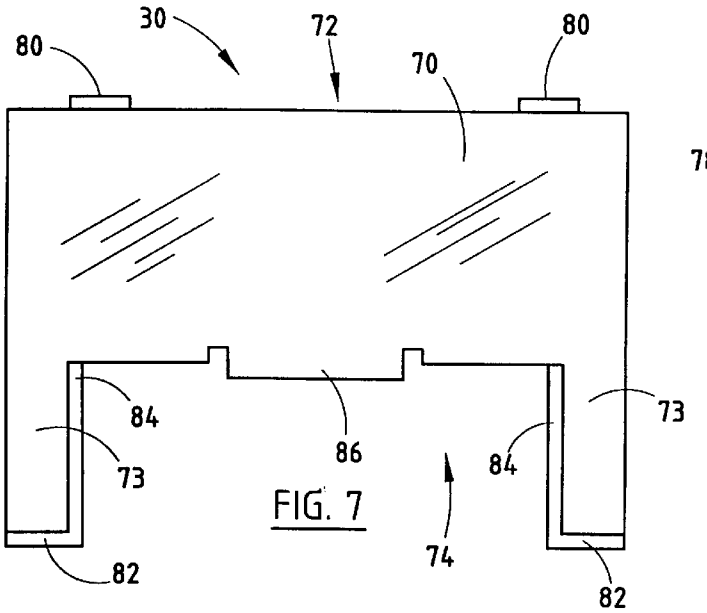
FIG. 7 is a plan view of the intermediate member.
Figure 9:
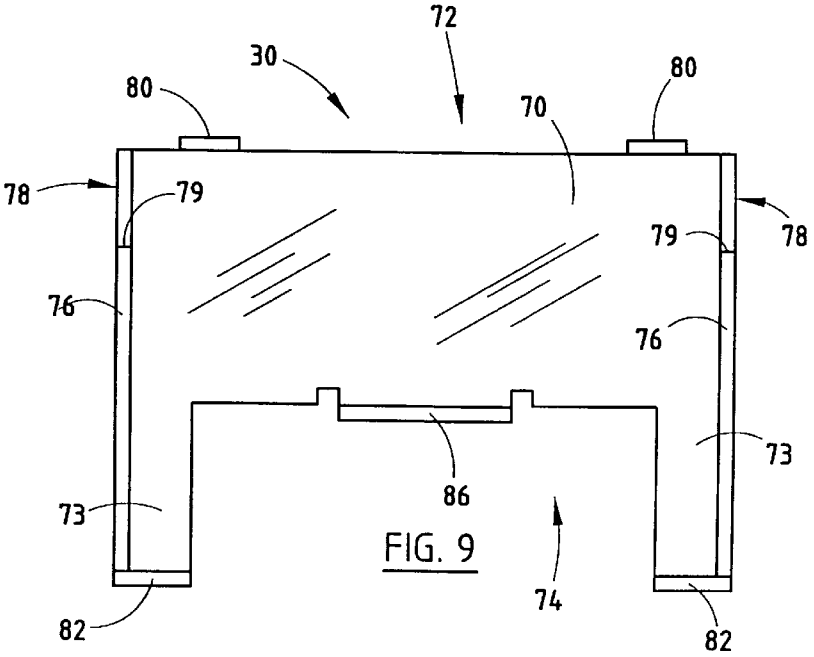
FIG. 9 is a bottom view of the intermediate member.
Figure 10:
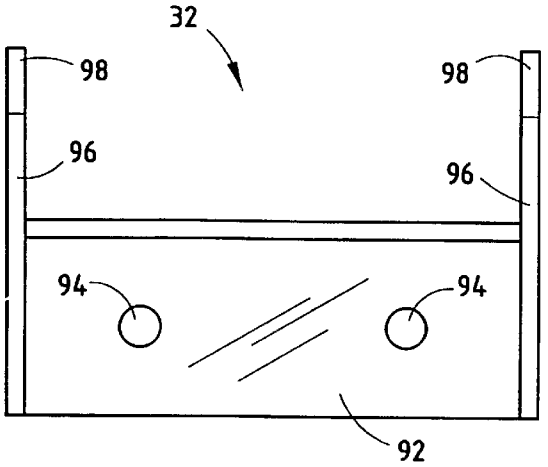
FIG. 10 is a bottom view of a bracket according to one embodiment in the present invention.
Figure 11:
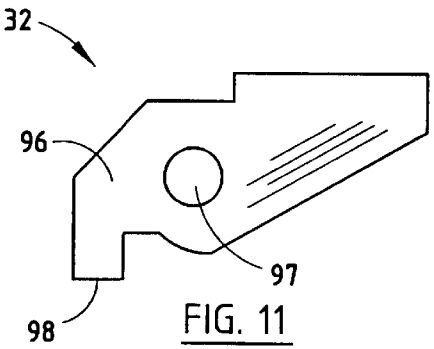
FIG. 11 is a side, elevational view of the bracket.
Figure 12:
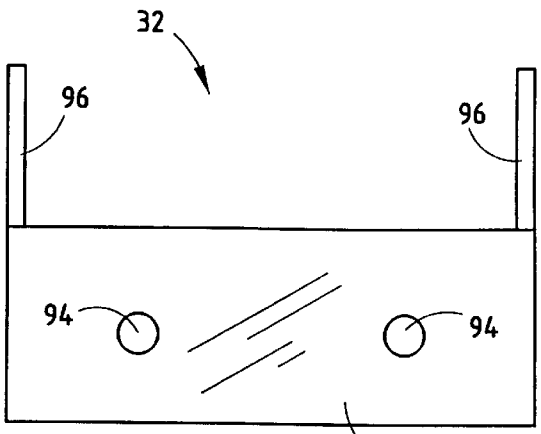
FIG. 12 is a plan view of the bracket.
Figure 13:
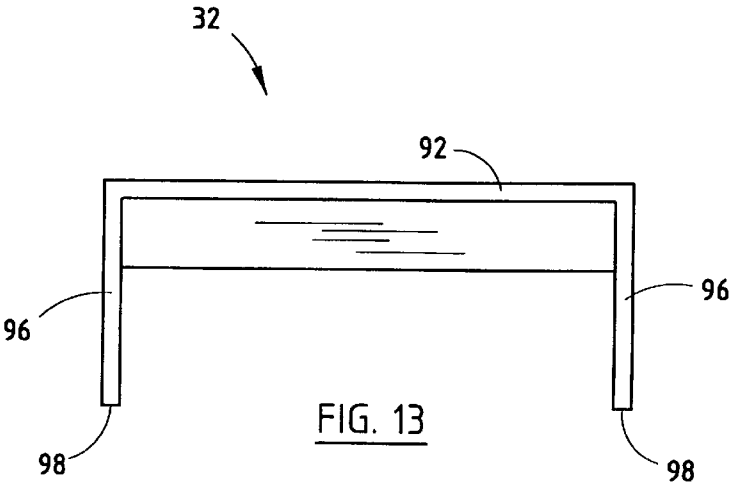
FIG. 13 is a rear, elevational view of the bracket.

Intermediate member 30 includes a generally planar body 70 having a front end 72, a rear end 74 with two rearwardly extending arms 73, and pair of downwardly turned sides which define slide members 76 (FIGS. 1 and 6–9). Slide members 76 are located on opposite sides of planar body 70 and are oriented at right angles to planar body 70. A notch 78 is defined in an undersurface 75 of each slide member 76 adjacent front end 72 of intermediate member 30. Notches 78 each include a rear surface 79 and a front surface 81 (FIG. 8). Front surface 81 is oriented at an angle θ with respect to undersurface 75 and θ is equal to 30° in the preferred embodiment. Rear surface 79 of notch 78 is oriented preferably at an angle of 25° with respect to undersurface 75. Of course, it will be understood that θ and the orientation of rear surface 79 with respect to undersurface 75 can be varied without departing from the scope of the invention. Undersurface 75 slidingly engages angled sliding surface 56 of base 28 (FIG. 1). When intermediate member 30 has been pulled away from base 28, notches 78 receive indexing edge or engagement lip 55 on bottom 46 of slide track 44 (See FIGS. 16 and 17). The weight of vehicle gate 22 pushes rear end 74 of intermediate member 30 downward, thereby enabling intermediate member 30 to be releasably held in an extended position via the insertion of engagement lips 55 into notches 78. This resting, or releasable holding, of intermediate member 30 in the extended position is accomplished without the use of screws or other fasteners, thereby eliminating the extra step in prior extendable hinges of inserting a screw or the like. To overcome this rest position or releasable holding, gate 22 is merely lifted upward. The upward lifting of gate 22 moves rear end 74 of intermediate member 30 upward until slide members 76 are generally parallel to slide tracks 44 and intermediate member 30 can thereafter be slid forwardly into base 28. In other words, intermediate member 30 is lifted until the rear surface 79 of notch 78 no longer engages engagement lip 55 of slide track 44. Thus, to maintain hinge 20 in an extended position, no screws or the like are necessary, no parts are scuffed, and only a single, easy step of lifting is required to thereafter retract the hinge.

A pair of forward stops 80 are located at front end 72 of intermediate member 30 (FIGS. 1 and 6–9). Forward stops 80 are spaced from each other and extend upwardly from planar body 70 at a right angle generally adjacent slide members 76. Forward stops 80 are precisely located on planar body 70 to engage extension limit surfaces 60 on base 28 and thereby prevent the extension of intermediate member 30 out of slide channel 44 of base 28. A pair of rear stops 82 are located at rear end 74 of intermediate member 30, also adjacent slide members 76. Rear stops 82 are likewise oriented at a right angle to planar body 70 and are positioned to engage retraction limit surfaces 58 of base 28 when intermediate member 30 has been retracted into base 28. When rear stops 82 are in contact with retraction limit surface 58, intermediate member 30 is in a fully retracted position.

A pair of bearing flanges 84 are located on intermediate member 30 inwardly from arms 73 and are oriented at right angles to planar body 70 and parallel to the direction of extension and retraction of intermediate member 30 (FIGS. 6–9). Bearing flanges 84 each define an aperture 85 through which pivot pin 34 is inserted. Pivot pin 34 in combination with bearing flanges 84 allows bracket 32 to rotate or pivot with respect to base 28 and intermediate member 30. An engagement flange 86 is located between bearing flanges 84 along rear end 74 of intermediate member 30. Engagement flange 86 extends downwardly from planar body 70 and at a right angle thereto. A circular threaded aperture 88 is defined in engagement flange 86 and aligns with circular threaded apertures 66 in retaining flange 62 of base 28. When intermediate member 30 is in a fully retracted position, engagement flange 86 contacts retaining flange 62 and the insertion of a screw, or the like, through circular threaded apertures 66 and 88 secures intermediate member 30 to base 28 in the retracted position.

Bracket 32 includes a gate attachment plate 92 which defines one or more attachment apertures (FIGS. 10–13).

Inserted through attachment apertures 94 are screws, or the like, which secure bracket 32 to the vehicle gate or rear door 22. It will be understood by those skilled in the art that the precise number and location of attachment apertures 94 on gate attachment plate 92 can vary substantially from that disclosed in the illustrated embodiment, and may include other fasteners for securing bracket 32 to gate 22. A pair of bracket bearing flanges 96 are located on either side of gate attachment plate 92 and each defines an aperture 97. Apertures 97 receive pivot pin or axle 34. Bracket 32 is thereby pivotable about an axis defined by pivot pin 34. The pivot of bracket 32 enables the rear door or gate 22 of the vehicle to be opened and closed. After pivot pin 34 is inserted through bearing flanges 96 on bracket 32 and bearing flanges 84 on intermediate member 30, pin 34 is secured therein by a washer-type nut commonly referred to as a pal nut. Bracket bearing flanges 96 each include a limit surface 98 which contacts planar body 70 of intermediate member 30 when bracket 32 has been pivoted upwardly. The limit surfaces 98 thereby define the maximum height to which the vehicle's rear door or gate 82 can be opened.

In the preferred embodiment base 28, intermediate member 30 and bracket 32 are each stamped from single pieces of sheet metal. It is therefore unnecessary when manufacturing each of the three components to perform any secondary operations, such as welding, riveting, or other steps to create these components. This decreases the manufacturing costs of hinge 20. In the preferred embodiment base 28, intermediate member 30, and bracket 32 are all stamped from steel sheet metal. It will be understood by those skilled in the art that materials other than steel can be used to manufacture hinge 20.

During the painting process of the vehicle, with base 28 secured to the vehicle body 24 and bracket 32 secured to gate 22, screw 36 is removed and intermediate member 30 is extended rearwardly from base 28 (FIG. 17). Intermediate member 30 is extended away from base 28 until indexing edges 55 of slide track 41 are received in notches 78. The weight of gate 22 retains notches 78 against indexing edges 55 such that intermediate member 30 is prevented from sliding towards base 28. No screw or other extraneous parts need be inserted into hinge 20 to retain intermediate member 30 in the extended position. While in this extended position, the vehicle is painted. After painting, the vehicle rear gate or door 22 is lifted sufficiently to overcome the resting of notches 78 on indexing edges 55 of base 28. After lifting, intermediate member 30 is free to slide and is then retracted into base 28. When fully retracted into base 28, screw 36 is simplistically re-inserted through circular threaded apertures 88 and 66 in engagement flange 86 and retaining flange 62, respectively, and thereby permanently secures intermediate member 30 to base 28 in the retracted position. Because no screws are used to hold hinge 20 in the extended position, no screws are scuffed, unduly moved, or color mismatched with other screws, thereby eliminating the disposal of any screws. If, during the life of the vehicle, screw 36 is removed from circular threaded apertures 66 and 88, gate 22 will be free to extend and retract towards and away from vehicle body 24 between the extended and the retracted position, but forward stops 80 will prevent intermediate member 30 from completely sliding out of slide tracks 44 of base 28. Door 22 will therefore not fall off the vehicle. The likelihood of gate 22 sliding between the extended and retraction position is further mitigated by the preferable use of two hinges 20 per gate 22.

While the present invention has been described in terms of the preferred embodiments depicted in the drawings as discussed in the above specification, it will be understood by one skilled in the art that the present invention is not limited to these particular preferred embodiments, but includes any and all such modifications that are within the spirit and scope of the present invention as defined in the appended claims.

The embodiments of the present invention in which an exclusive property or privilege is claimed are defined as follows:

1. A hinge for pivotally joining a moveable element to a stationary element, comprising:

a base adapted to be secured to said stationary element;

an intermediate member moveably secured to said base, said intermediate member movable from a retracted position adjacent said base to an extended position away from said base, one of said intermediate member and said base including at least one slide track and the other of said intermediate member and said base including at least one slide member adapted for sliding engagement with said slide track, said slide member adapted to be releasably held on said slide track when said intermediate member is in said extended position by way of gravity and an upward force applied to said intermediate member that lifts said intermediate member; and, a bracket pivotally secured to said intermediate member and adapted to be secured to said moveable element.

2. The hinge of claim 1 wherein said bracket defines a first aperture, said intermediate member defines a second aperture, and said bracket is pivotally secured to said intermediate member by an axle inserted through said first and second apertures.

3. The hinge of claim 1 wherein said stationary member is a vehicle body, said moveable member is a gate, and said extended position of said intermediate member is sufficiently far from said base to facilitate painting of said vehicle body and said gate.

4. The hinge of claim 1 wherein said intermediate member is selectively securable to said base in said retracted position by a single screw inserted into aligned apertures defined in said intermediate member and said base, and said screw is removed from said hinge when said intermediate member is in said extended position.

5. The hinge of claim 1 wherein said base, said intermediate member, and said bracket are each stamped from single pieces of sheet metal.

6. A hinge for pivotally joining a moveable element to a stationary element, comprising:

a base adapted to be secured to said stationary element;

an intermediate member moveably secured to said base, said intermediate member movable from a retracted position adjacent said base to an extended position away from said base, one of said intermediate member and said base including at least one slide track and the other of said intermediate member and said base including at least one slide member adapted for sliding engagement with said slide track, said slide member adapted to be releasably held on said slide track when said intermediate member is in said extended position, said slide member including a notch which receives an indexing edge on said slide track and said slide member being releasably held on said slide track while said indexing edge is received in said notch; and, a bracket pivotally secured to said intermediate member and adapted to be secured to said moveable element.

7. The hinge of claim 6 wherein said indexing edge is adapted to be removable from said notch by lifting said intermediate member with respect to said base.

8. The hinge of claim 6 wherein said intermediate member includes a forward stop which engages said base when said notch has received said indexing edge and prevents said intermediate member from being detached from said base.

9. A hinge for pivotally joining a moveable element to a stationary element, comprising:

a base adapted to be secured to said stationary element;

an intermediate member moveably secured to said base, said intermediate member movable from a retracted position adjacent said base to an extended position away from said base, one of said intermediate member and said base including at least one slide track and the other of said intermediate member and said base including at least one slide member adapted for sliding engagement with said slide track, said slide member adapted to be releasably held on said slide track when said intermediate member is in said extended position, said intermediate member including a front end facing said base and a rear end facing said bracket, said front end including a forward stop which limits the sliding of said intermediate member away from said base, and said rear end including a backward stop which limits the sliding of said intermediate member toward said base; and a bracket pivotally secured to said intermediate member and adapted to be secured to said moveable element.

10. A hinge for pivotally securing a gate to a vehicle body, comprising:

a base including at least one slide track;

an intermediate member including at least one slide member adapted to slidingly engage said at least one slide track, said intermediate member including a front end facing said base and a rear end facing said bracket, said front end including a forward stop which limits the sliding of said intermediate member away from said base, and said rear end including a backward stop which limits the sliding of said intermediate member toward said base, said intermediate member defining a first aperture, said intermediate member slidably secured to said base and slidable from a retracted position adjacent said base to an extended position away from said base;

a pin inserted through said first aperture; and a bracket defining a second aperture through which said pin is also inserted wherein said bracket is pivotally secured to said intermediate member.

11. The hinge of claim 10 wherein said slide member and said slide track, are adapted to, selectively prohibit retraction of said intermediate member into said base when said intermediate member is in the extended position without the insertion of extraneous parts into said hinge.

12. The hinge of claim 11 wherein said base, said intermediate member, and said bracket are each stamped from single pieces of sheet metal.

13. The hinge of claim 12 wherein said bracket includes a pair of pivot stops which limit the extent of pivotal movement of said bracket with respect to said intermediate member.

14. The hinge of claim 13 wherein said intermediate member is selectively securable to said base in said retracted position by a single screw inserted into aligned apertures defined in said intermediate member and said base, and said screw is removed from said hinge when said intermediate member is in said extended position.

15. A hinge for pivotally securing a gate to a vehicle body, comprising:

a base including at least one slide track, said base adapted to be secured to the vehicle body;

an intermediate member including at least one slide member adapted to slidingly engage said at least one slide track, each said slide member including a notch which receives an indexing edge on said slide track and said slide member being releasably held on said slide track while said indexing edge is received in said notch, said intermediate member defining a first aperture, said intermediate member slidably secured to said base and slidable from a retracted position adjacent said base to an extended position away from said base;

a pin inserted through said first aperture; and a bracket defining a second aperture through which said pin is also inserted wherein said bracket is pivotally secured to said intermediate member, said bracket adapted to be secured to said gate.

16. A hinge for pivotally joining a gate to a vehicle body, comprising:

a base adapted to be secured to said vehicle body, said base including a vehicle attachment plate having two sides and a pair of substantially parallel sidewalls at each side of said vehicle attachment plate, each said sidewall extending upwardly from said vehicle attachment plate and defining a slide track oriented at a first angle to said vehicle attachment plate;

a retaining flange on said base, said retaining flange extending upwardly at a second angle from said vehicle attachment plate between said pair of sidewalls, said retaining flange defining an aperture therein;

an intermediate member slidably secured to said base, said intermediate member slidable from a retracted position adjacent said base to an extended position away from said base, said intermediate member including a planar body and a pair of substantially parallel slide members oriented at a right angle to said planar body, said slide members adapted to slidingly engage said slide track, said intermediate member further including a downwardly extending flange defining an aperture, said downwardly extending flange adapted to abut said retaining flange of said base and secure said intermediate member to said base when said intermediate member is in said retracted position and a screw is inserted through said apertures in said retaining flange and said downwardly extending flange; and, a bracket pivotally secured to said intermediate member and adapted to be secured to said moveable element.

17. The hinge of claim 16 further including a pin which is inserted through aligned bearings in said bracket and said intermediate member wherein said bracket pivots with respect to said intermediate member about said pin.

18. The hinge of claim 17 wherein said intermediate member includes a front end facing said base and a rear end facing said bracket, said front end including a stop which limits the sliding of said intermediate member toward said base, and said rear end including a stop which limits the sliding of said intermediate member away from said base.

19. The hinge of claim 18 wherein each said slide track includes an engagement lip and each said slide member includes a notch which receives said engagement lip and holds said intermediate member in said extended position until said slide member is lifted and said engagement lip is no longer received in said notch.

20. The hinge of claim 19 wherein said base, said intermediate member, and said bracket are each stamped from single pieces of sheet metal.

* * * * *

UNITED STATES PATENT AND TRADEMARK OFFICE

CERTIFICATE OF CORRECTION

PATENT NO. : 5,937,480
DATED : August 17, 1999
INVENTOR(S) : James (NMI) Kiefer

It is certified that error appears in the above-identified patent and that said Letters Patent is hereby corrected as shown below:

Column 1,
Line 45: Delete the duplicated words "they hold the hinge".

Column 3,
Line 48: Insert the words --a right-- between the words "at" and "angle".

Column 5,
Line 11: Add --ing-- to the word "pivot" between the words "The" and "of".

Signed and Sealed this

Second Day of October, 2001

*Attest:*

Nicholas P. Godici

NICHOLAS P. GODICI
*Acting Director of the United States Patent and Trademark Office*

*Attesting Officer*